United States Patent [19]

Hashimoto et al.

[11] Patent Number: 4,584,473

[45] Date of Patent: Apr. 22, 1986

[54] BEAM DIRECT CONVERTER

[75] Inventors: Kiyoshi Hashimoto, Yokohama; Toru Sugawara, Fujisawa, both of Japan

[73] Assignee: Tokyo Shibaura Denki Kabushiki Kaisha, Kawasaki, Japan

[21] Appl. No.: 523,762

[22] Filed: Aug. 17, 1983

[30] Foreign Application Priority Data

Sep. 29, 1982 [JP] Japan ..... 57-168543

[51] Int. Cl.[4] ..... H05H 3/02

[52] U.S. Cl. ..... 250/251; 376/130

[58] Field of Search ..... 250/251; 376/130, 147

[56] References Cited

U.S. PATENT DOCUMENTS

| | | | |
|---|---|---|---|
| 3,668,065 | 6/1972 | Moir | 376/147 |
| 4,349,505 | 9/1982 | Stirling | 376/130 |
| 4,480,185 | 10/1984 | Hashimoto | 250/251 |

OTHER PUBLICATIONS

"Direct Energy Conversion" Lawrence Livermore Laboratory Rept. UCRL 50002-75, 10-15-75, pp. 44-47.

"Design Study of a 120-keV, $^3$He Neutral Beam Injector," Blum et al., Journal of Fusion Energy, vol. 1, No. 1, 1981, pp. 69-86.

*Primary Examiner*—Bruce C. Anderson
*Assistant Examiner*—Paul A. Guss
*Attorney, Agent, or Firm*—Oblon, Fisher, Spivak, McClelland & Maier

[57] ABSTRACT

A beam direct converter recovers the energy of incoming ion particles intermingled with neutral particles. An angular cylindrical collector of the direct converter has its lengthwise side substantially aligned with the flowing direction of a beam of neutral particles. Angular cylindrical suppressors are provided upstream and downstream of the collector as viewed from the flowing direction of the beam of neutral particles. The collector is set at a positive potential to decelerate ion particles taken into the collector. Suppressors set at a negative potential prevent electrons produced outside of the direct converter from being carried into the collector. A plurality of conductive pipes are embedded in the suppressor. When the conductive pipes are supplied with current running in the same direction, a magnetic field acting in parallel with the plane of the suppressor envelops it. When, therefore, ion particles enter the suppressor with the emission of secondary electrons, it is possible to confine the secondary electrons in the magnetic field, thereby preventing them from being carried into the collector.

22 Claims, 9 Drawing Figures

BEAM DIRECT CONVERTER

BACKGROUND OF THE INVENTION

This invention relates to a beam direct converter used with a neutral beam injector (hereinafter abbreviated as NBI) for heating a plasma.

FIG. 1 is an exploded oblique view of the NBI fitted with a beam direct converter. FIG. 2 indicates the potential distribution in the NBI elements, showing the lateral sectional view of the NBI. A gas to be ionized, for example, hydrogen gas or deuterium gas is fed into a discharge chamber 10. Voltage is applied between the thermionic cathode 10*a* of the discharge chamber 10 and anode wall 10*b* (which is set at, for example, 200 KV as shown in FIG. 2), giving rise to the discharge of a gas and the growth of a plasma. Ions such as $H^+$ or $D^+$ are drawn off from the plasma by means of a grid electrode 12, and conducted at an accelerated speed to a neutralization cell 14 (which is, for example, grounded as shown in FIG. 2). The neutralization cell 14 is filled with, for example, a gas of hydrogen or deuterium having a relatively high pressure. A high energy ion beam accelerated by a grid electrode is subjected to a charge exchange reaction between gas molecules and high energy ions in the neutralization cell 14, and turned into an accelerated neutral beam. This accelerated neutral beam is injected into a plasma 28 by being guided through a drift tube 26. A vacuum vessel 22 (FIG. 1) in which the neutralization cell 14 is set is evacuated by a cryo pump 24.

That portion of an ion beam which was not neutralized by the neutralization cell 14 is also drawn off therefrom. The unneutralized ions are deviated from the flow of a neutral beam due to a self electric field being created by said unneutralized ions and strike against the walls of the vacuum vessel 22 and drift tube 26. These walls are damaged by the energy released from the unneutralized ions. As a plasma 28 is applied in an increasing size, a neutral beam must have a higher energy. However, a neutralizing efficiency will be reduced if a neutral beam is made to have a high energy. Where, with a beam of deuterium, an accelerated voltage stands at 50 KV, neutralization advances beyond 80%. In contrast where an accelerated voltage indicates 200 KV, neutralization is achieved only to an extent to 20%. Therefore, the energy loss of the unneutralized ions permeating the neutralization cell 14 and the damage to the walls of the vessel 22 and drift tube 26 raise greater problems.

For resolution of such problems, a beam direct converter for recovering ion energy in the form of a current (which comprises electron suppressors 16, 20 and a collector 18 provided therebetween) has hitherto been interposed between the neutralizing cell 14 and drift tube 26. As seen from FIG. 2, the voltage of the collector 18 and electron suppressors 16, 20 are respectively set at levels of 180 KV, −60 KV and −20 KV. An accelerated ion beam is decelerated by an electric field produced between the collector 18 and electron suppressor 16. The decelerated ion beam is taken into the collector 18, where the energy of said beam is recovered in the form of current. On the other hand, the electron suppressors 16, 20 held at a negative potential collectively build up an electrostatic potential barrier against electrons generated in other members (for example, the neutralizing cell etc.) than the beam direct converter, thereby preventing electrons from being carried into the collector 18 and consequently avoiding the loss of current recovered by the collector 18.

With the conventional beam direct converter, however, gases flowing out of the neutralization cell 14 and gasified deuterium ions prevail near the electron suppressors 16, 20 and collector 18. Collision between an ion beam and the gas molecules lead to the growth of charged particles in the beam direct converter. Ions generated in the beam direct converter collide with the electron suppressors 16, 20, leading to not only current loss, but also the generation of heat and the release of secondary electrons. Entry of said released secondary electrons into the collector 18 results in the loss of recovered current and a reduction in the recovery efficiency of the direct beam converter. When a $D^+$ ion beam accelerated to 200 KeV is recovered by a residual energy of 20 KeV, it is assumed that the electron suppressor 16 is impressed with a voltage of −60 KV, an electric field created in the recovery region has a strength of 7 KV/cm, and a pressure of $1\times10^{-4}$ Torr. Then about 2.5% of an incident ion power brought into the beam direct converter is lost by the thermal load of the electron suppressor 16. This loss indeed can not be overlooked, but falls within an allowable range, because said loss does not constitute an important portion of the loss of incoming ion power occurring in the whole of the direct converter. In this connection, it is to be noted that electrons are released over incoming ions. When the electron suppressor 16 is prepared from, for example, molybdenum, the secondary electron emission coefficient is about 3/ion. Therefore, ion power loss caused by released secondary electrons accounts for as much as about 6.3% of incident ion power delivered to the beam direct converter. This loss is extremely large, when it is considered that the residual incident ion power which is recovered in the form of current accounts for 10% of the incident ion power. The generation of charged particles in the beam direct convertor can indeed be suppressed by a reduction in the pressure prevailing in the vacuum vessel 22. The attainment of this object, however, is accompanied with the drawback that the cryo pump 24 must have increased capacity.

Ions produced outside of the beam direct converter or primary ions reflected from the surface of the collector 18 are also brought into the electron suppressor 16. As a result, this electron suppressor 16 releases heat, and emits secondary electrons. Said secondary electrons also lead to the loss of recovered ion power.

SUMMARY OF THE INVENTION

It is accordingly the object of this invention to provide a beam direct converter in which the secondary electrons released from an electron suppressor are confined within the region near the suppressor, thereby assuring a reduction in the loss of recovered ion power.

To attain the above-mentioned object, this invention provides a beam direct converter for recovering the energy of ions flowing into the beam direct converter, which comprises:

collecting means which collects ion particles and converts the energy of the collected ion particles into electrical energy;

suppressing means which is positioned upstream of the collecting means as viewed from the flowing direction of the ion particles, and is chosen to have a negative potential to prevent electrons from being carried into the collecting means, and is further provided with means for generating a magnetic field to suppress the efflux of electrons from the neighboring regions of said suppressing means.

Ion particles strike against gas particles prevailing near the suppressing means and collecting means to generate charged particles. The ions involved in the charged particles collide with the suppressing means, causing secondary electrons to be released from the suppressing means. According to the present invention, the released secondary electrons are confined within the region near the suppressing means by a magnetic field created by the magnetic field-generating means, thereby preventing the released secondary electrons from being carried from the proximity of the suppressing means into the collecting means, avoiding the loss of recovered energy caused by released secondary electrons, and assuring a high energy-recovering efficiency.

DETAILED DESCRIPTION OF THE PREFERRED EMBODIMENTS

Figure 1:
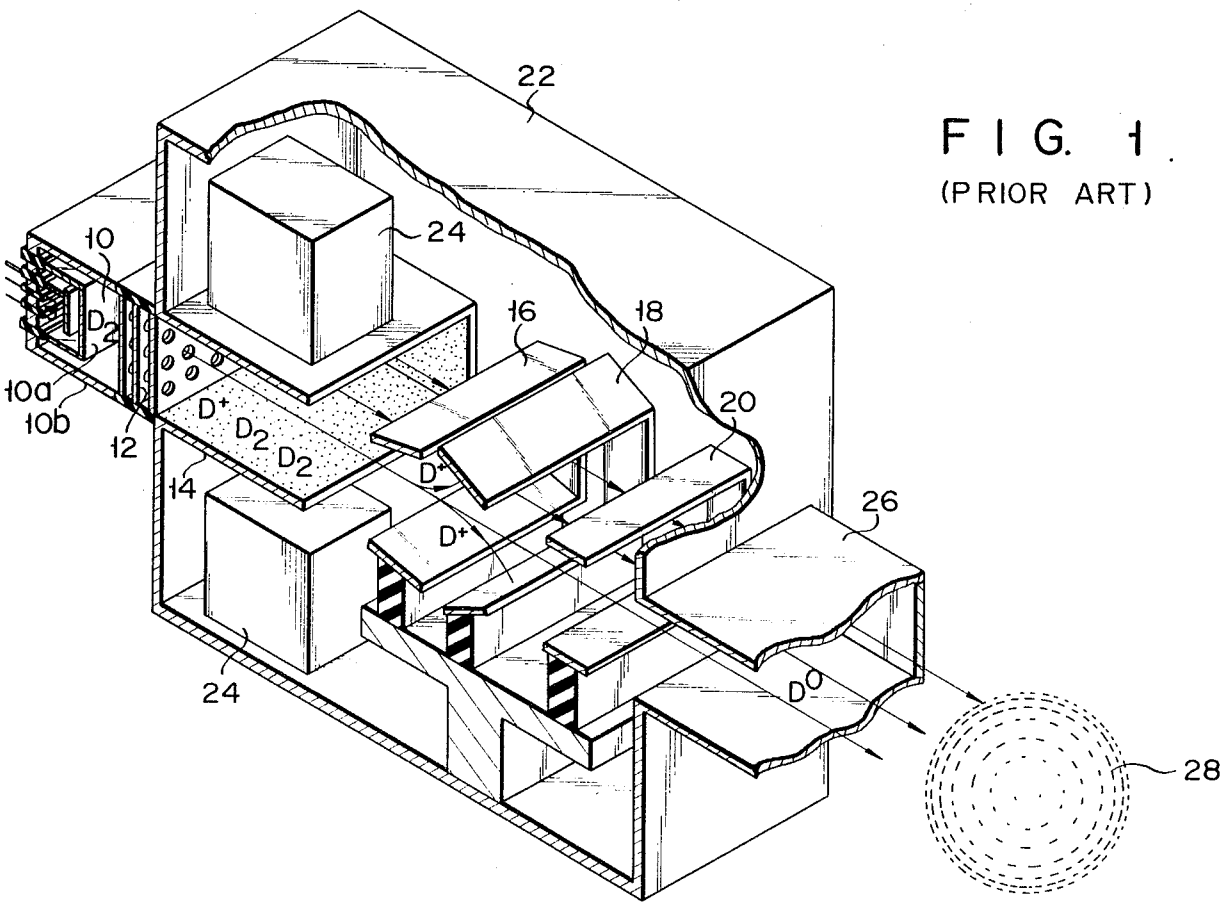
FIG. 1 (PRIOR ART)
FIG. 1 is an exploded view of the NBI fitted with the conventional beam direct converter.
Figure 2:
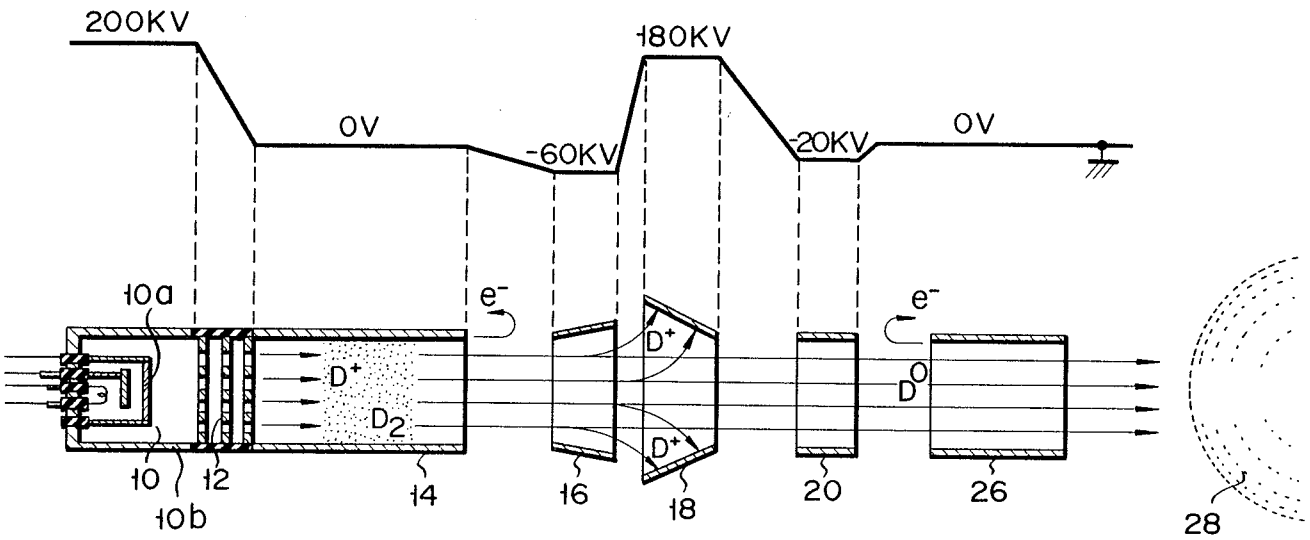
FIG. 2 (PRIOR ART)
FIG. 2 is a lateral sectional view of the NBI, showing the distribution of the potentials of the respective elements thereof.
Figure 3:
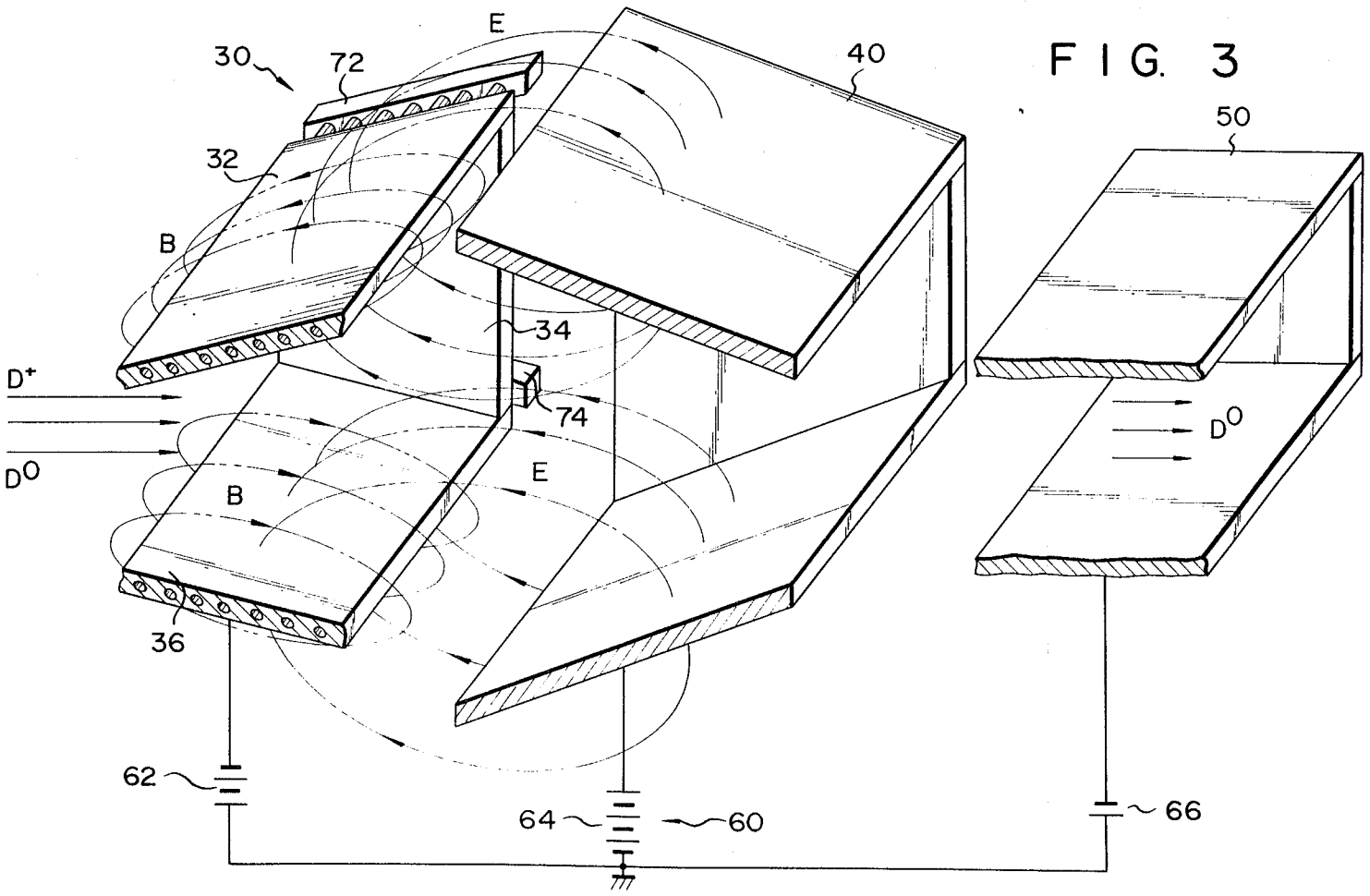
FIG. 3 is an exploded view of a beam direct converter according to a first embodiment of this invention.
Figure 4:
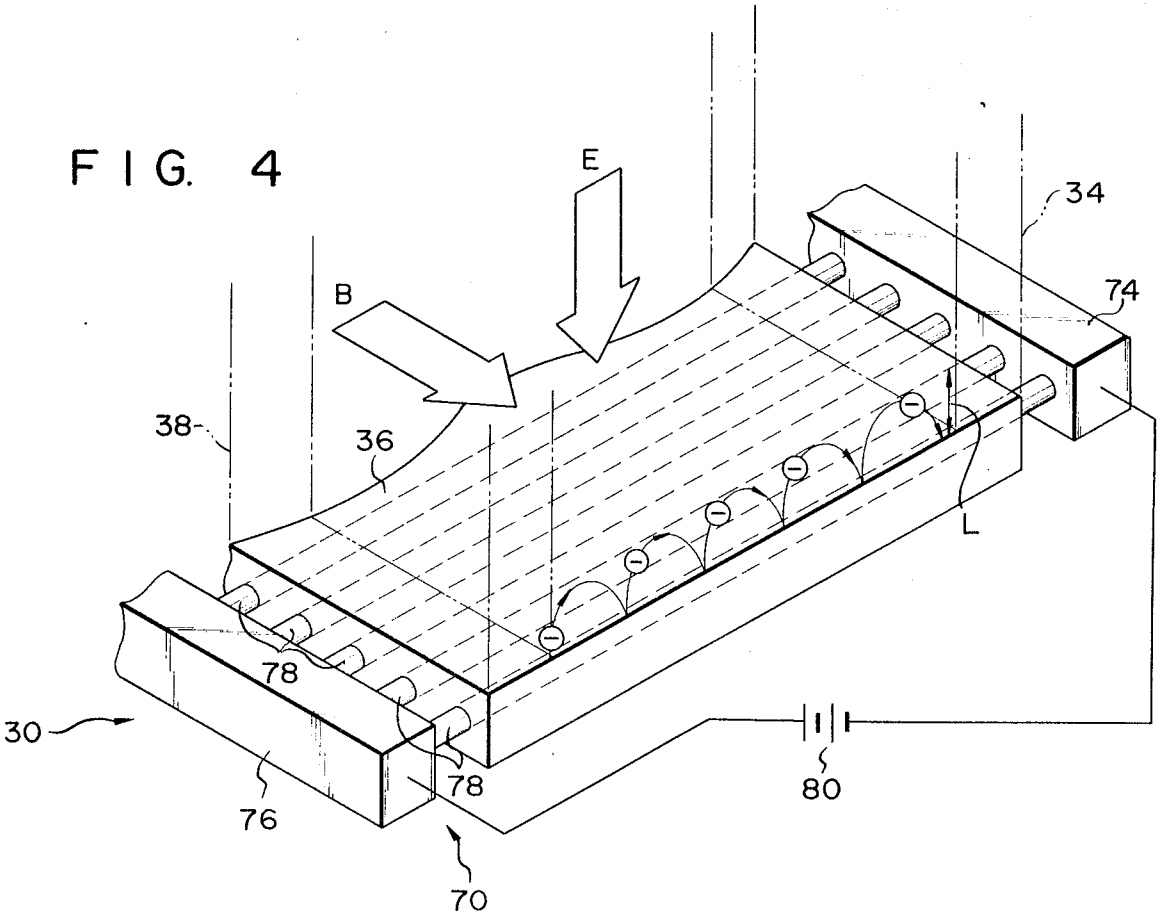
FIG. 4 is an enlarged perspective view of the suppresser of the beam direct converter of FIG. 3.

FIG. 3 indicates the main section of a beam direct converter according to a first embodiment of this invention, showing the arrangement of electrodes and the potentials thereof. FIG. 4 illustrates a first electron suppressor 30 constituting one of the electrodes indicated in FIG. 3. The beam direct converter of FIG. 3 embodying this invention is fitted, for example, to the NBI of FIG. 1. In this case, the beam direct converter is interposed between a neutralization cell 14 and drift tube 26. An accelerated neutral beam consisting of, for example, a deuterium atom $D^0$ is carried from the neutralization cell 14 into the beam direct converter. The neutral beam is intermingled with accelerated ion particles consisting of, for example, deuterium ions $D^+$ which were not neutralized in the neutralization cell 14. Referring to FIG. 3, the first electron suppressor 30, a collector 40 and a second electron suppressor 50 all involved in the beam direct converter are arranged in the order mentioned along the direction (indicated by solid line arrows in FIG. 3) in which the neutral beam flows. The suppressor 30, 50 and collector 40 are all made of an angular metal cylinder whose lateral side is aligned with the direction (indicated by the solid line arrows) in which the neutral beam flows in a state surrounding the streams of the ion and neutral beams. The first suppressor 30 is set at a negative potential of, for example, −60 KV by a power source 62 involved in electric-field generating means 60. The collector 40 is set at a positive potential by a power source, namely, at 180 KV when the accelerated energy of an ion beam has, for example, 200 KeV. The second suppressor 50 is set at a negative potential of, for example, −20 KV. Therefore, an electric field E acting from the collector 40 to the first suppressor 30 is produced as indicated by a one-dot dash line in FIG. 3 between the collector 40 and first suppressor 30. The first suppressor 30 held at a negative potential builds up an electrostatic potential barrier against electrons generated in the neutralization cell 14 (FIG. 1). An electric field acting from the collector 40 to the second suppressor 50 is also created between the collector 40 and second suppressor 50. The second suppressor 50 held at a negative potential builds up an electrostatic potential barrier against electrons generated in the drift tube 26 (FIG. 1).

The first suppressor 30 is formed of four conductive electrode plates 32, 34, 36, 38 (though only three electrode plates 32, 34, 36 are shown in FIG. 3). The respective electrode plates are fixed together along the mutually facing edges, forming an angular cylinder as a whole. A plurality of conductive pipes 78 collectively acting as magnetic-field generating means 70 are embedded in the respective electrode plates. Description will now be given of a rectangular electrode plate 36 shown in FIG. 4. A plurality of conductive pipes 78 are embedded in the electrode plate 36 in a state extending at right angles to the direction in which a stream of ion particles flows. The conductive pipes 78 are spatially insulated from each other as well as from the electrode plate 36. The conductive pipes 78 project outward at both ends from the shorter sides of the rectangular electrode plate 36. The projecting portions communicate at both ends with cooling water feeders 74, 76. Cooling water is conducted into the pipes 78 from one of the feeders 74, 76. After flowing through the conductive pipes 78, the cooling water is drawn off from the other of the feeders 74, 76. The water feeders 74, 76 are electrically connected to the conductive pipes 78. A power source 80 impresses D.C. voltage across the feeders 74, 76, causing current to run through the conductive pipes 78, for example, from the water feeder 76 to the water feeder 74. When power runs through the conductive pipes 78, a magnetic field B is generated around the electrode plate 36 as indicated by two-dot dash lines in FIG. 3 in a state enveloping the whole of the electrode plate 36. A plurality of conductive pipes 78 are embedded in each of the other electrode plates 32, 34 and 38 (this one is shown in FIG. 4). Cooling water flows through the conductive pipes 78 of the electrode plates 32, 34 and 38 as well as current. As in the case of the electrode plate 36, therefore, a magnetic field B is created around the respective electrode plates 32, 34, 38. The foregoing description relates to the ordinary case where a pair of cooling water feeders 74, 76 are fit to each of the electrode plates 32, 34, 36, 38 to allow for the passage of power and cooling water through an independent cycle system represented by each of said electrode plates 32, 34, 36, 38. Further, it is possible to electrically connect the four groups of plural conductive pipes 78 embedded in each of the electrode plates 32, 34, 36, 38 in mutual communication and connect a pair of water feeders 72, 76 spatially arranged along the diagonal line of the first suppressor 30 shaped like an angular cylinder to the conductive pipes 78 so as to assure water passage. In this case, D.C. voltage is impressed on both water feeders 76, 72 in such a manner that the water feeder 76 is set at a positive potential and the water feeder 72 is set at a negative potential. Cooling water is carried from the water feeder 76 through the conductive pipes 78 and drawn off from the conductive pipes 78 through the water feeders 72. Then, current runs from the water feeder 76 to the water feeder 72 through the conductive pipes 78 embedded in the electrodes 36, 34 and also through the conductive pipes 78 embedded in the electrodes 38, 32. Therefore, a magnetic field B acting in the direction in which a stream of ion particles flow is produced inside of the first suppressor 30 substantially in parallel with the surface of the electrode plates 32, 34, 36, 38.

Description will now be given of a beam direct converter constructed as described above. The beam direct converter receives a neutral beam consisting of, for example, $D^o$ and an ion beam consisting of, for example, $D^+$ supplied from the neutralization cell in a direction indicated by solid line arrows in FIG. 3. The neutral beam runs straight forward through the beam direct converter in a direction indicated by solid line arrows. The ions are scattered by an electrostatic repulsive force between ions. An ion beam deviated from a neutral beam is delivered to the electrode plates of the collector 40. The ion beam is decelerated by an electric field created between the collector 40 and first suppressor 30 and then is carried into the collector 40. The ion beam now entering the collector 40 is recovered in the form of current. Electrons produced outside of the beam direct converter involving the neutralization cell 14, etc., are prevented from entering the collector 40 by the first suppressor 30 acting as an electrostatic potential barrier. Gases flowing out of the neutralization cell 14 (see FIG. 1) and gasified incoming ions are retained near the suppressor 30 and collector 40. When ion particles strike against the retained gas molecules, charged particles are produced. Ions included in this charged particles impinge on the electrode plates 32, 34, 36, 38 of the first suppressor 30. The inpingement of the ions causes secondary electron emission from said electrode plates. The released secondary electrons are prevented from being emitted from the proximity of said electrode plates by a magnetic field created by charge conducted through the pipes 78 so as to envelop electrode plates. Therefore, it is possible to avoid the loss of the recovered current of ion energy which might otherwise result from the incoming of the released secondary electrons into the collector 40.

As seen from FIG. 4, an electric field E prevailing near, for example, the electrode plate 36 may be said to act almost uniformly on the whole region of the electrode plate 36 in a direction substantially at right angles thereto. When the pipes 78 are embedded close to each other in the electrode plate 36, a magnetic field B created by conduction of current through the pipes 78 acts almost in parallel with the surface of the electrode plates, and a magnetic flux prevailing near the electrode plates may be considered to have a substantially constant density. The energy of the released electrons is so much smaller than the strength of the electric field E that this energy can be regarded as substantially zero. Consequently, the released electrons define a cycloid locus by the action of the magnetic field B, and make a drift motion near the electrode plates as shown in FIG. 4. When low energy electrons such as those defining the cycloid locus are introduced, a coefficient related to the emission of secondary electrons from the electrode plates caused by primary electron impingement generally indicates a smaller number than one. Consequently the electrons progressively decrease in number, each time they strike against the electrodes while defining a cycloid locus. Eventually, the release of electrons ceases.

Now let it be assumed that $\omega_c$ denotes an electron cyclotron frequency; E shows the strength of an electric field; and B represents the magnetic flux density. Then, a maximum distance L (FIG. 4) at which emitted secondary electrons are removed from the surface of the electrode plate may be expressed by the following formula (1):

$$L=E/(B\cdot\omega_c) \quad (1)$$

If the maximum distance L is taken to be 2 cm, the density B of a magnetic flux required to confine electrons in the magnetic field is assured to be about 140 gauss. This magnetic flux density B can be obtained by conducting current through the pipes 78 to such an extent that a current running across the electrode plate has a density of about 220 A/cm. This current density can be realized by manufacturing the pipes 78 from the ordinary conducting materials.

Like the first suppressor 30, a second suppressor 50 acts as an electrostatic potential barrier against electrons produced in the drift tube, thereby preventing these electrons from being conducted into the collector. Like the first suppressor 30, the second suppressor 50 may be provided with magnetic-field generating means. This arrangement can prevent secondary electrons released from the second suppressor 50 from being carried into the collector 40. Obviously, this second suppressor can be omitted as occasion arises.

Figure 5:
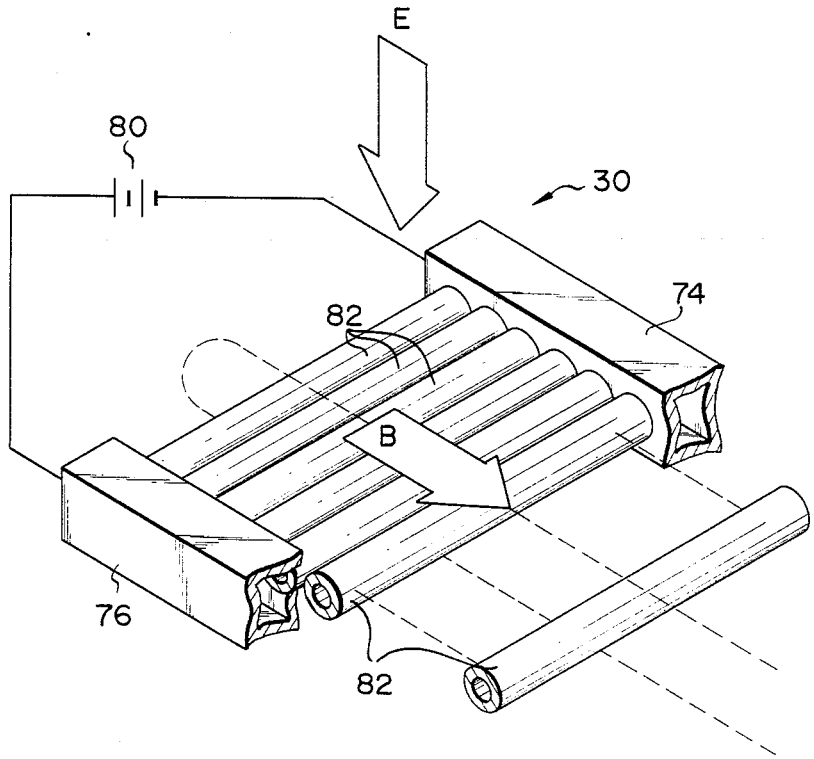
FIG. 5 is a perspective view of a first modification of said suppressor.

Description will now be given with reference to FIG. 5 of a first modification of the first suppressor 30. With this modification, a plurality of pipes 82 extend between the water feeders 74, 76. The pipes 82 are arranged to form a hollow rectangular solid.

The pipes 82 themselves function like the electrode plates of the first suppressor 30. If, in this case, the pipes 82 are spaced apart from each other at a large distance, gas from the beam direct converter is subject to a small discharge resistance, thereby reducing the gas pressure in the beam direct converter and avoiding the generation of charged particles. Even if the pipes 82 are widely spaced from each other, it is possible to obtain a sufficiently high magnetic flux density to confine secondary electrons released from the pipes 82 by allowing larger current to run through the pipes 82. If the suppressor is never heated to a temperature more than several hundred degrees centigrade, they need not be cooled. In this case, the pipes 78 or 82 may be replaced by a solid, electrically conductive rod. On the other hand, gas may be used as coolant.

Figure 6:
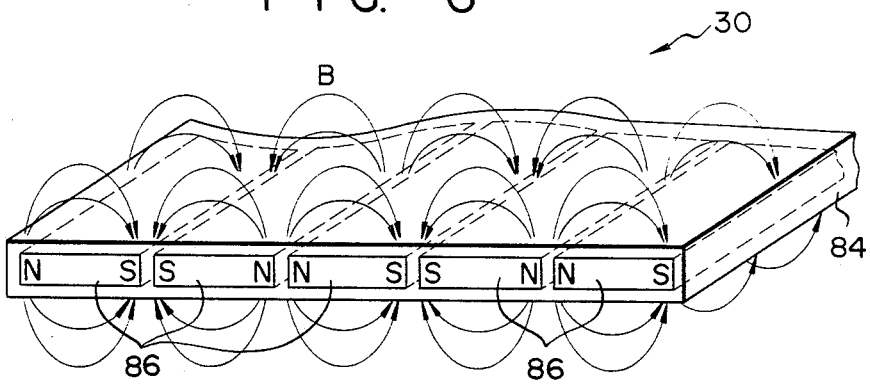
FIG. 6 is a perspective view of a second modification of said suppressor.
Figure 7:
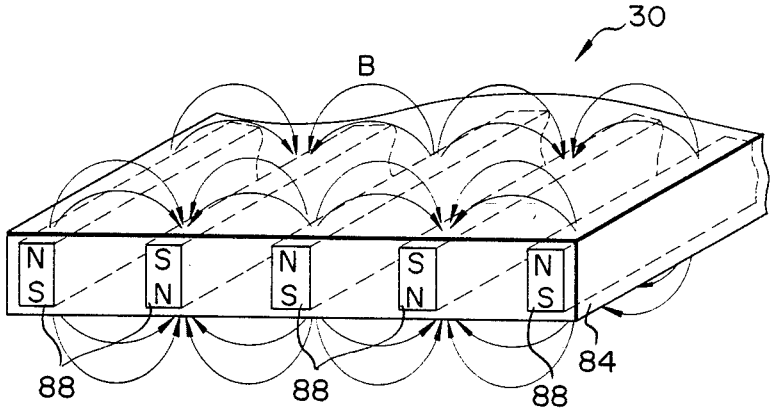
FIG. 7 is a perspective view of a third modification of said suppressor.

FIGS. 6 and 7 show second and third modifications of the first suppressor 30. In the second modification of FIG. 6, a plurality of plate-shaped permanent magnets 86 are spatially embedded in a rectangular electrode plate 84 lengthwise thereof in a state extending in parallel across said electrode plate 84. The horizontally set poles N and S of the respective plate-shaped permanent magnets 86 are arranged in such a manner that the horizontally set poles N and S of the alternate permanent magnets 86 are positioned reversely from those of the adjacent permanent magnets 86. A loop-shaped magnetic field B is produced near the electrode plate 84 as seen from FIG. 6. In the third modification of FIG. 7, a plurality of angular rod-shaped permanent magnets 88 are likewise spatially embedded in a rectangular electrode plate 84 lengthwise thereof in a state extending in parallel across said electrode plate 84. The vertically set poles N and S of said angular rod-shaped permanent magnets 88 are arranged in such a manner that the vertically set poles N and S of the alternate permanent magnets 88 are reversely positioned from those of the adjacent permanent magnets 88. In FIG. 7, a loop-shaped magnetic field B is created near the electrode plate 84 as in FIG. 6. The magnetic field B prevents secondary electrons emitted from the electrode plate 84 from leaking from that vicinity.

Figure 8:
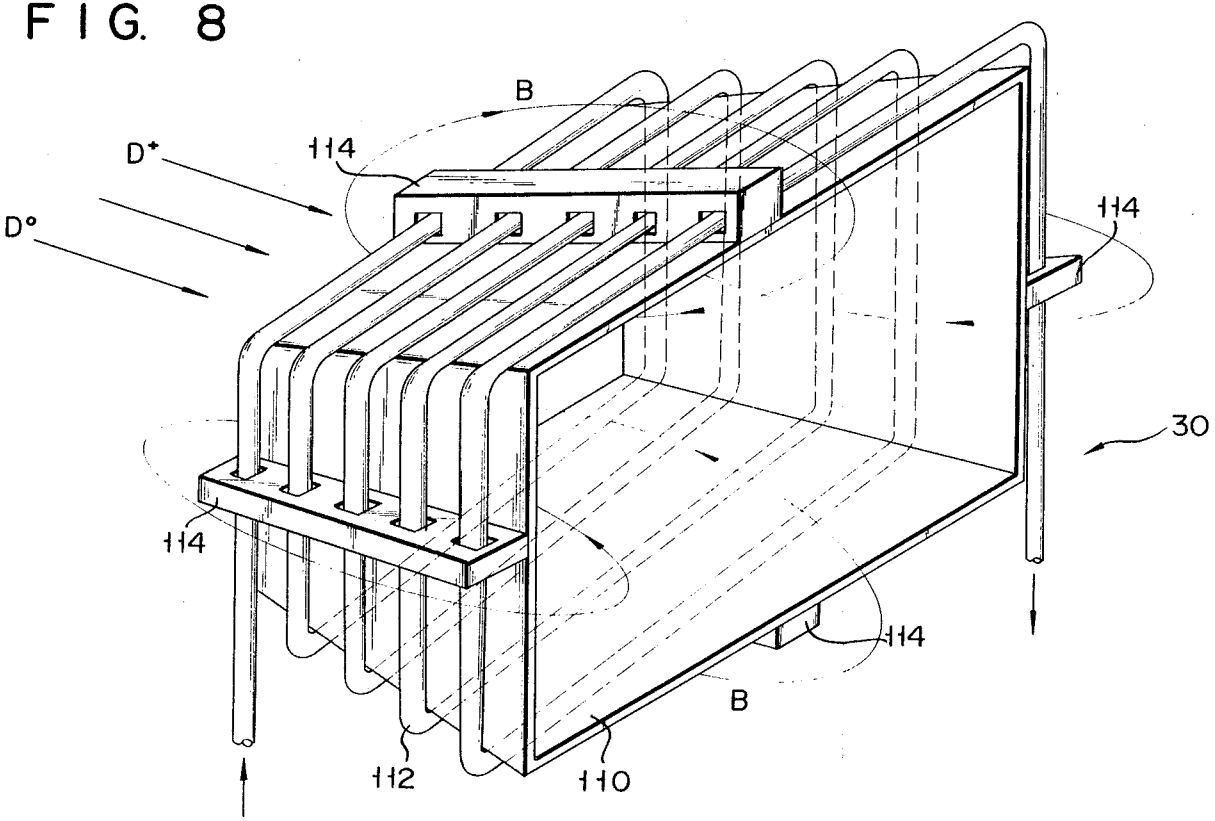
FIG. 8 is a perspective view of a fourth modification of said suppressor.

FIG. 8 shows a fourth modification of the first suppressor 30. This suppressor 30 has an electrode 110 formed of an angular metal cylinder. The electrode 110 is set at a negative potential by a power source 62 (FIG. 3) to build up an electrostatic potential barrier against electrons. The electrode is inserted in a hollow conductor 112 formed of a coil fixed to a support 114 made of insulating material, e.g., ceramics. Cooling water may flow through this hollow conductor 112 to cool the conductor 112. When electric current flows through the conductor 112, a magnetic field B develops in the direction of the two-dot dash line shown in FIG. 8. This magnetic field B prevents secondary electrons emitted from the electrode 110 from leaking from the conductor 112.

Throughout the foregoing embodiments, the electrode suppressors and collector were shaped like an angular cylinder to be used with an electron beam whose cross section indicated a flat plate. However, the beam direct converter of this invention is also applicable to a device using a beam different from the NBI.

Figure 9:
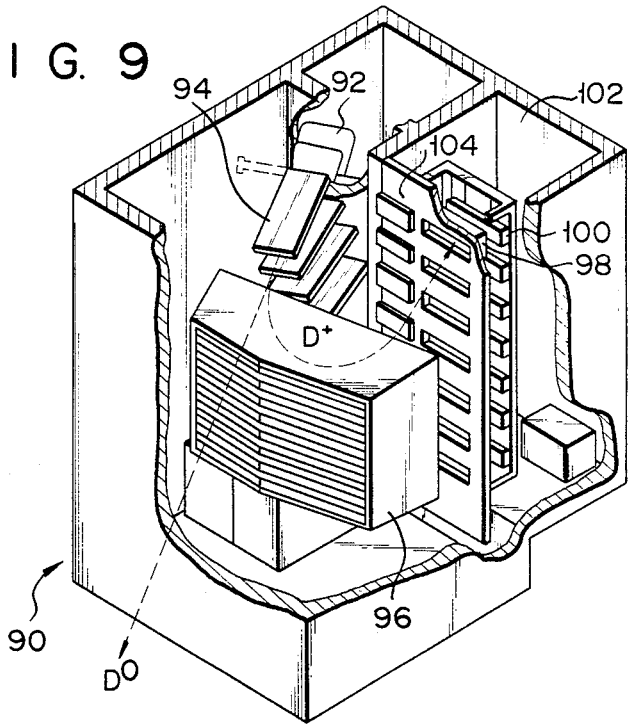
FIG. 9 is an exploded view of a beam direct converter according to a second embodiment of this invention.

Further, the beam direct converter of the invention may be constructed in the form of an off line type as illustrated in FIG. 9. In this embodiment, deuterium ion $D^+$ is supplied to a neutralizer 94 from an ion source 92. A neutral beam $D^o$ of deuterium which was neutralized in the neutralizer 94 and a beam $D^+$ of ions which were not neutralized in the neutralizer 94 are taken into a deflection magnet 96. The nonneutralized ion beam $D^+$ is deflected by a deflection magnet 96 to be carried to a collector 100 set behind the deflection magnet 96. The neutral beam $D^o$ proceeds straight forward. The collector 100 is disposed within the converter room 102. The converter room 102 is defined by a wall 104. The wall 104 has a plurality of holes for the passage of ion beams. An electron suppressor 98 is provided between the collector 100 and the wall 104. The suppressor 98 is set at a negative potential to suppress the flow of electrons to the collector 100. The ion collector 100, which is set at a positive potential, decelerates the unneutralized ion beam $D^+$, thereby collecting the energy of this ion beam $D^+$. In this case a magnetic field is created around the suppressor 98. Even when, therefore, ions generated in the proximity of the suppressor 98 are carried into the suppressor 98 to release secondary electrons, these emitted secondary electrons are confined within the magnetic field and do not enter the collector 100.

What is claimed is:

1. A beam direct converter for recovering the energy of ions, comprising:

collecting means for collecting ions and converting the energy of the collected ions into electrical energy;

electron suppressing means, provided upstream of the collecting means in the beam of ions entering the beam direct converter, for suppressing the passing of electrons produced outside the beam direct converter; and magnetic-field generating means for generating a magnetic field to suppress the leaking of secondary electrons produced by the suppressing means, from the vicinity of the suppressing means.

2. The beam direct converter according to claim 1, which further comprises another electron suppressing means, positioned downstream of the collecting means, for suppressing the passing of electrons produced outside the beam direct converter.

3. The beam direct converter according to claim 1, wherein said collecting means is a collector, said suppressing means is a suppressor set at a potential lower than the potential of the collector to produce an electric field extending from said collector to said suppressor.

4. The beam direct converter according to claim 3, wherein said collector and said suppressor are angular cylinder-shaped, are positioned substantially in line with the incoming beam of ions, and are set at a positive and negative potential, respectively.

5. The beam direct converter according to claim 4, wherein the suppressor comprises electrode plates; the magnetic-field generating means comprises a plurality of conductive rods embedded in parallel in each of the electrode plates in a state insulated from each other and also from the electrode plates; and a source of power for supplying the conductive rods with current running in the same direction.

6. The beam direct converter according to claim 5, wherein each conductive rod is a conductive pipe, through which cooling medium flows.

7. The beam direct converter according to claim 4, wherein the suppressor comprises a plurality of rod-shaped electrodes which extend at right angles to the lengthwise direction of the suppressor and are arranged to form a hollow rectangular solid; and the magnetic field-generating means comprises a power source for supplying the rod-shaped electrodes with current running in the same direction.

8. The beam direct converter according to claim 7, wherein the rod-shaped electrode is a conductive pipe, through which cooling medium flows.

9. The beam direct converter according to claim 4, wherein the suppressor comprises an electrode plates; and the magnetic-field generating means comprises a plurality of permanent magnets embedded in each of the electrode plates.

10. The beam direct converter according to claim 9, wherein a plurality of plate-shaped permanent magnets are spatially embedded in each of the electrode plates lengthwise thereof in a state extending in parallel across the electrode plate, and the horizontally set poles of the respective plate-shaped permanent magnets are arranged in such a manner that the horizontally set poles of the alternate magnets are positioned reversely from those of the adjacent permanent magnets.

11. The beam direct converter according to claim 9, wherein a plurality of rod-shaped permanent magnets are spatially embedded in each of the electrode plates lengthwise thereof in a state extending in parallel across the electrode plates, and the vertically set poles of the rod-shaped permanent magnets are arranged in such a manner that the vertically set poles of the alternate permanent magnets are reversely 5 positioned from those of the adjacent permanent magnets.

12. The beam direct converter according to claim 4, wherein the magnetic-field generating means is comprised of a hollow conductor formed of coil and surrounding the suppressor and a power source for supplying electric current to the hollow conductor.

13. The beam direct converter according to claim 2, further comprising another second magnetic-field generating means for producing a magnetic field capable of suppressing the leaking of secondary electrons produced by the suppressing means, from the vicinity of the other electron suppressing means.

14. The beam direct converter according to claim 13, wherein the other electron suppressing means comprises an angular cylinder-shaped suppressor whose lengthwise direction is substantially aligned with the incoming direction.

15. The beam direct converter according to claim 14, wherein the suppressor comprises an electrode plates; and the other magnetic-field generating means comprises a plurality of conductive rods embedded in parallel in each of the electrode plates in a state insulated from each other and also from the electrode plates, and a source of power for supplying the conductive rods with current running in the same direction.

16. The beam direct converter according to claim 15, wherein each conductive rod is a conductive pipe, through which cooling medium flows.

17. The beam direct converter according to claim 14, wherein the suppressor of the other suppressing means comprises a plurality of electrode rods extending in parallel at right angles to the lengthwise direction of the suppressor which are arranged to form a hollow rectangular solid; and the other magnetic field-generating means comprises a power source for supplying the electrode rods with current running in the same direction.

18. The beam direct converter according to claim 17, wherein each rod-shaped electrode is a conductive pipe, through which cooling medium flows.

19. The beam direct converter according to claim 14, wherein the suppressor of the other suppressing means comprises electrode plates; and the other magnetic field-generating means comprises a plurality of permanent magnets embedded in each of the electrode plates.

20. The beam direct converter according to claim 19, wherein a plurality of plate-shaped permanent magnets are spatially embedded in each of the electrode plates lengthwise thereof in a state extending in parallel across the electrode plate; and the horizontally set poles of the respective plate-shaped permanent magnets are arranged in such a manner that the horizontally set poles of the alternate permanent magnets are positioned reversely from those of the adjacent permanent magnets.

21. The beam direct converter according to claim 19, wherein a plurality of rod-shaped permanent magnets are spatially embedded in each of the electrode plates lengthwise thereof in a state extending in parallel across the electrode plates; and the vertically set poles of the rod-shaped permanent magnets are arranged in such a manner that the vertically set poles of the alternate permanent magnets are reversely positioned from those of the adjacent permanent magnets.

22. The beam direct converter according to claim 14, wherein the other magnetic-field generating means is comprised of a hollow conductor formed of coil and surrounding the suppressor and a power source for supplying electric current to the hollow conductor.

* * * * *